US009318062B2

(12) United States Patent
Tsuda et al.

(10) Patent No.: US 9,318,062 B2
(45) Date of Patent: Apr. 19, 2016

(54) LIQUID CRYSTAL DISPLAY DEVICE AND METHOD OF DRIVING THE SAME

(71) Applicant: Japan Display Inc., Minato-ku (JP)

(72) Inventors: Hiroki Tsuda, Tokyo (JP); Junichi Kobayashi, Tokyo (JP)

(73) Assignee: Japan Display Inc., Minato-ku (JP)

( * ) Notice: Subject to any disclaimer, the term of this patent is extended or adjusted under 35 U.S.C. 154(b) by 232 days.

(21) Appl. No.: 14/033,775

(22) Filed: Sep. 23, 2013

(65) Prior Publication Data

US 2014/0085348 A1 Mar. 27, 2014

(30) Foreign Application Priority Data

Sep. 26, 2012 (JP) ..... 2012-212141

(51) Int. Cl.
*G09G 5/10* (2006.01)
*G09G 3/36* (2006.01)

(52) U.S. Cl.
CPC ..... *G09G 3/3614* (2013.01); *G09G 3/3648* (2013.01); *G09G 2320/0204* (2013.01); *G09G 2320/0257* (2013.01)

(58) Field of Classification Search
CPC ..... G09G 3/36; G09G 3/3614; G02F 1/1343
USPC ..... 345/87, 96, 690
See application file for complete search history.

(56) References Cited

U.S. PATENT DOCUMENTS

2003/0048248 A1* 3/2003 Fukumoto et al. ..... 345/89
2008/0204646 A1* 8/2008 Lim ..... 349/126
2011/0122114 A1* 5/2011 Tanaka et al. ..... 345/211
2011/0242469 A1* 10/2011 Kawamura et al. ..... 349/138

FOREIGN PATENT DOCUMENTS

JP 2011-112865 6/2011
KR 20-0116970 Y1 5/1998
KR 10-2005-0025446 A 3/2005

OTHER PUBLICATIONS

Office Action issued Feb. 26, 2015 in Korean Patent Application No. 10-2013-0112734 (with English language translation).
Office Action issued Jun. 24, 2014, in Korean Patent Application No. 10-2013-112734 with English translation.

* cited by examiner

*Primary Examiner* — Calvin C Ma
(74) *Attorney, Agent, or Firm* — Oblon, McClelland, Maier & Neustadt, L.L.P.

(57) ABSTRACT

According to one embodiment, a liquid crystal display device includes a driving module configured to apply a DC bias to a voltage corresponding to a gradation which is displayed on a pixel and to supply a resultant voltage to a pixel electrode, the driving module being configured to apply a higher DC bias in a white display state in which a potential difference is produced between a pixel electrode and a common electrode than in a black display state in which no potential difference is produced between the pixel electrode and the common electrode.

21 Claims, 7 Drawing Sheets

LIQUID CRYSTAL DISPLAY DEVICE AND METHOD OF DRIVING THE SAME

CROSS-REFERENCE TO RELATED APPLICATIONS

This application is based upon and claims the benefit of priority from Japanese Patent Application No. 2012-212141, filed Sep. 26, 2012, the entire contents of which are incorporated herein by reference.

FIELD

Embodiments described herein relate generally to a liquid crystal display device and a method of driving the same.

BACKGROUND

By virtue of such advantageous features as light weight, small thickness and low power consumption, liquid crystal display devices have been used in various fields as display devices of OA equipment, such as personal computers, and TVs. In recent years, liquid crystal display devices have also been used as display devices of portable terminal equipment such as mobile phones, car navigation apparatuses, game machines, etc.

In recent years, a liquid crystal display panel of a fringe field switching (FFS) mode or an in-plane switching (IPS) mode has been put to practical use. The liquid crystal display panel of the FFS mode or IPS mode is configured such that a liquid crystal layer is held between an array substrate, which includes a pixel electrode and a common electrode, and a counter-substrate, and switching is realized by rotating liquid crystal molecules of the liquid crystal layer in a plane parallel to the substrates. Such a display mode has an advantage of, for example, a wide viewing angle.

In the structure of the FFS mode or IPS mode, there has been a demand for an improvement of various display defects due to a displacement of an alignment direction of liquid crystal molecules from a desired direction. For example, in some cases, an image persistence phenomenon occurs on the liquid crystal display device of the FFS mode. The image persistence phenomenon is such a phenomenon that, for example, if an intermediate gradation image is displayed on the entire screen after a black-and-white checkered pattern is displayed on the screen, the checkered pattern slightly remains like an after-image. In recent years, various methods have been proposed for relaxing such an image persistence phenomenon.

DETAILED DESCRIPTION

Figure 1:
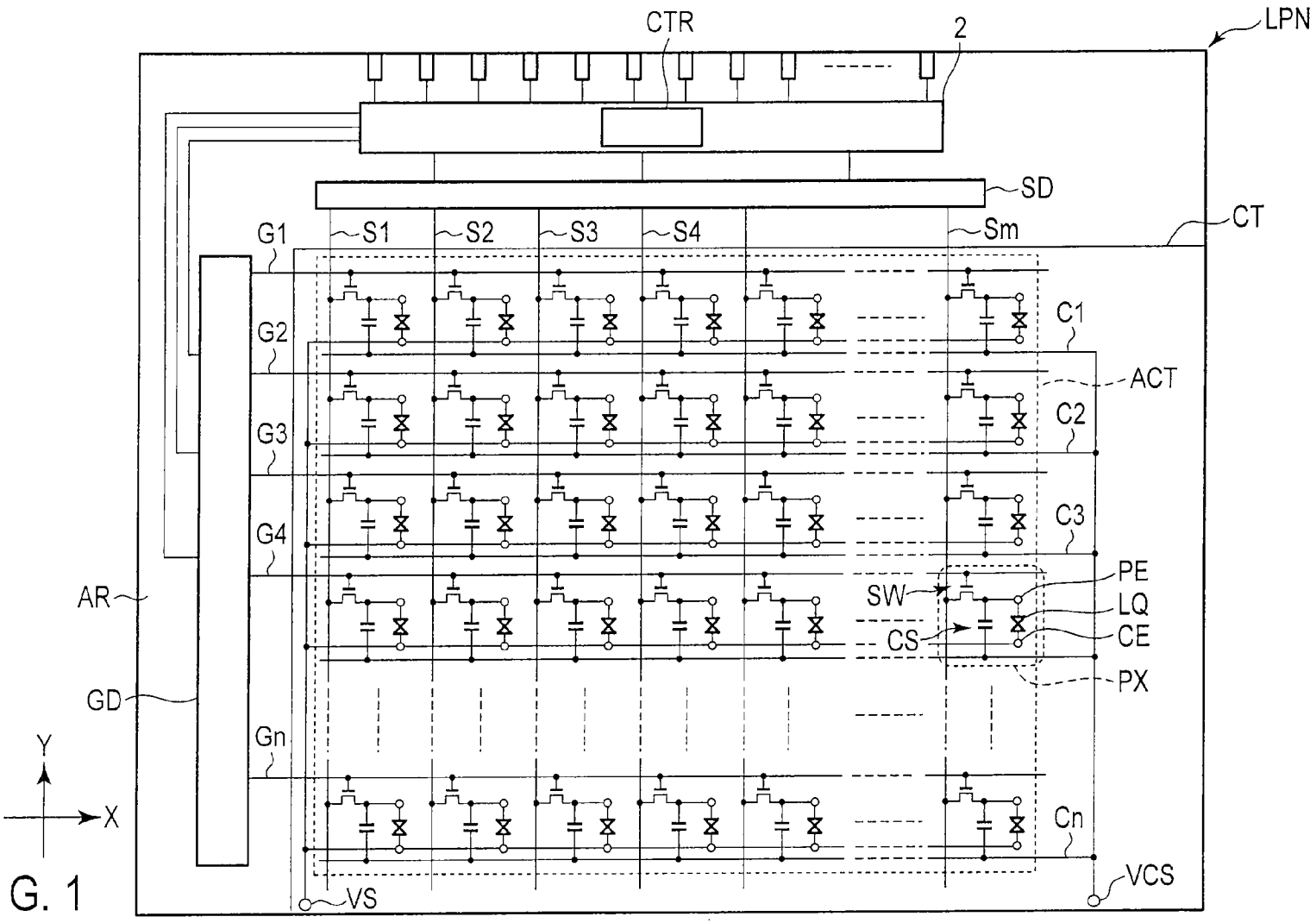
FIG. 1 is a view which schematically illustrates a structure and an equivalent circuit of a liquid crystal display panel, which constitutes a liquid crystal display device according to an embodiment.

In general, according to one embodiment, a liquid crystal display device includes: a first substrate including a switching element disposed in each of pixels of an active area, a common electrode disposed over a plurality of pixels, a pixel electrode electrically connected to the switching element and disposed in each of the pixels, and a first alignment film; a second substrate including a second alignment film which is opposed to the first alignment film; a liquid crystal layer including liquid crystal molecules held between the first alignment film and the second alignment film; and a driving module configured to apply a DC bias to a voltage corresponding to a gradation which is displayed on the pixel and to supply a resultant voltage to the pixel electrode, the driving module being configured to apply a higher DC bias in a white display state in which a potential difference is produced between the pixel electrode and the common electrode than in a black display state in which no potential difference is produced between the pixel electrode and the common electrode.

According to another embodiment, a method of driving a liquid crystal display device, the liquid crystal display device includes: a first substrate including a switching element disposed in each of pixels of an active area, a common electrode disposed over a plurality of pixels, an insulation film disposed on the common electrode, a pixel electrode electrically connected to the switching element, disposed in each of the pixels on the insulation film and having a slit formed to face the common electrode, and a first alignment film; a second substrate including a second alignment film which is opposed to the first alignment film; and a liquid crystal layer including liquid crystal molecules held between the first alignment film and the second alignment film, the method comprising applying a higher DC bias in a white display state in which a potential difference is produced between the pixel electrode and the common electrode than in a black display state in which no potential difference is produced between the pixel electrode and the common electrode, at a time of applying a DC bias to a voltage corresponding to a gradation which is displayed on the pixel and supplying a resultant voltage to the pixel electrode.

According to another embodiment, a method of driving a liquid crystal display device, the liquid crystal display device includes: a first substrate including a switching element disposed in each of pixels of an active area, a common electrode disposed over a plurality of pixels, a pixel electrode electrically connected to the switching element and disposed in each of the pixels, and a first alignment film covering the pixel electrode; a second substrate including a second alignment film which is opposed to the first alignment film; and a liquid crystal layer including liquid crystal molecules held between the first alignment film and the second alignment film, the method comprising applying a higher DC bias in a white display state in which a potential difference is produced between the pixel electrode and the common electrode than in a black display state in which no potential difference is produced between the pixel electrode and the common electrode, at a time of applying a DC bias to a voltage corresponding to a gradation which is displayed on the pixel and supplying a resultant voltage to the pixel electrode.

Embodiments will now be described in detail with reference to the accompanying drawings. In the drawings, structural elements having the same or similar functions are denoted by like reference numerals, and an overlapping description is omitted.

FIG. 1 is a view which schematically shows a structure and an equivalent circuit of a liquid crystal display panel LPN, which constitutes a liquid crystal display device according to an embodiment.

Specifically, the liquid crystal display device includes an active-matrix-type transmissive liquid crystal display panel LPN. The liquid crystal display panel LPN includes an array substrate AR which is a first substrate, a counter-substrate CT which is a second substrate that is disposed to be opposed to the array substrate AR, and a liquid crystal layer LQ which is held between the array substrate AR and the counter-substrate CT. The liquid crystal display panel LPN includes an active area ACT which displays an image. The active area ACT is composed of a plurality of pixels PX which are arrayed in a matrix of m×n (m and n are positive integers).

The array substrate AR includes, in the active area ACT, an n-number of gate lines G (G1 to Gn) and an n-number of storage capacitance lines C (C1 to Cn) extending in a first direction X, an m-number of source lines (S1 to Sm) extending in a second direction Y which is perpendicular to the first direction X, a switching element SW which is electrically connected to the gate line G and source line S in each pixel PX, a pixel electrode PE which is electrically connected to the switching element SW in each pixel PX, and a common electrode CE which is opposed to the pixel electrode PE.

Each of the gate lines G is led out of the active area ACT and is connected to a gate driver GD. Each of the source lines S is led out of the active area ACT and is connected to a source driver SD. Each of the storage capacitance lines C is led out of the active area ACT and is electrically connected to a voltage application module VCS to which a storage capacitance voltage is applied. The common electrode CE is electrically connected to a power supply module VS to which a common voltage (Vcom) is applied. At least parts of the gate driver GD and source driver SD are formed on, for example, the array substrate AR, and are connected to a driving IC chip 2. In the example illustrated, the driving IC chip 2 functions as a signal source necessary for driving the liquid crystal display panel LPN, and includes a controller CTR which controls the gate driver GD and source driver SD, controls the common voltage that is applied to the power supply module VS, and controls the storage capacitance voltage that is applied to the voltage application module VCS. The driving IC chip 2 is mounted on the array substrate AR on the outside of the active area ACT of the liquid crystal display panel LPN. The source driver SD (or the source driver SD and controller CTR) functions as a driving module that applies a DC bias, which is level-set where necessary, to a voltage corresponding to a gradation which is displayed on the pixel PX, and supplies the resultant voltage to the pixel electrode PE.

The liquid crystal display panel LPN of the example illustrated is configured to be applicable to an FFS mode or an IPS mode, and the array substrate AR includes the pixel electrode PE and common electrode CE. In the liquid crystal display panel LPN with this structure, liquid crystal molecules, which constitute the liquid crystal layer LQ, are switched by mainly using a lateral electric field which is produced between the pixel electrodes PE and the common electrode CE (e.g. that part of a fringe electric field, which is substantially parallel to the substrate major surface).

Figure 2:
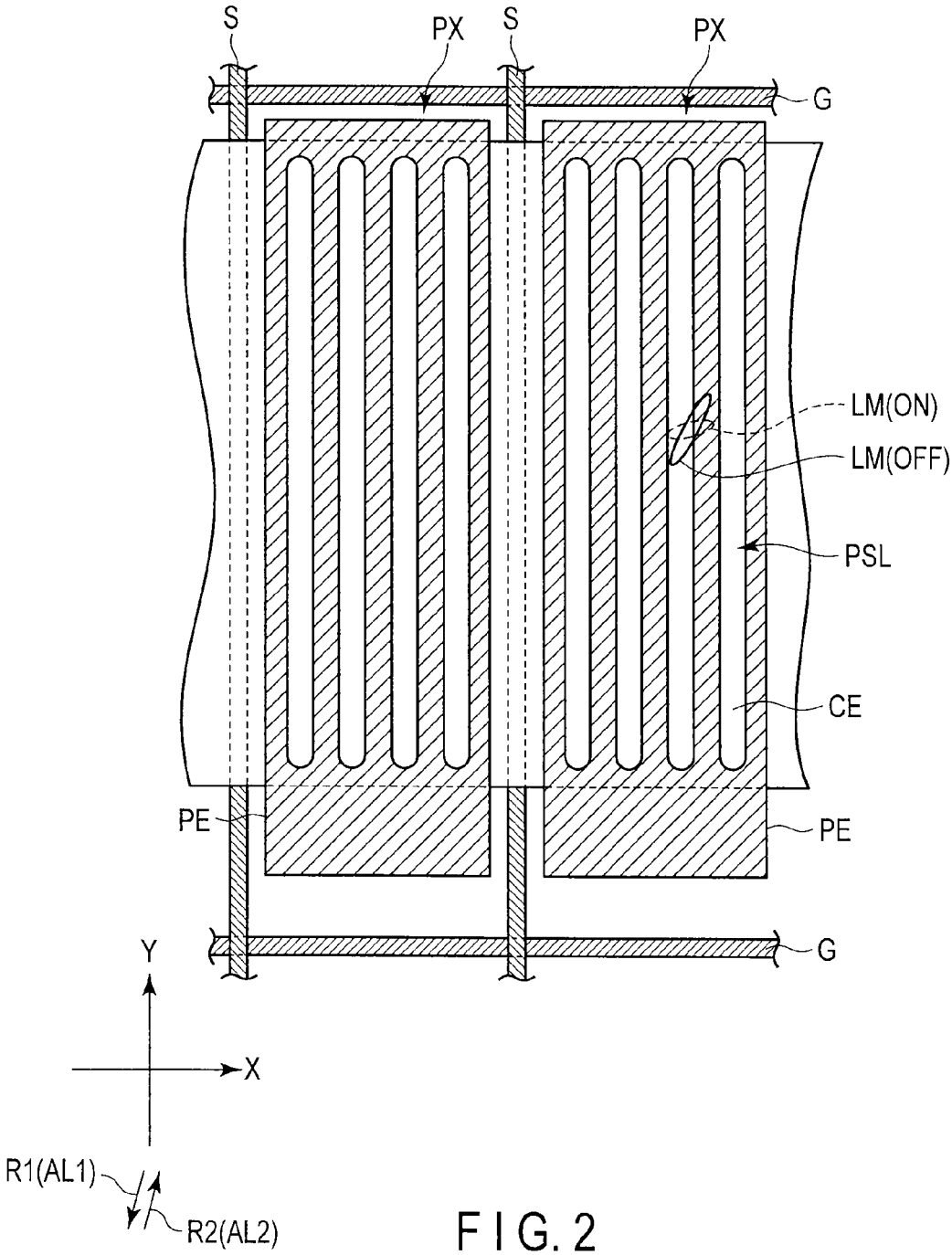
FIG. 2 is a plan view which schematically shows, from a counter-substrate side, an example of the structure of pixels on an array substrate shown in FIG. 1.

FIG. 2 is a plan view which schematically shows, from the counter-substrate CT side, an example of the structure of pixels PX on the array substrate AR shown in FIG. 1. FIG. 2 illustrates only a main part which is necessary for the description, and omits depiction of switching elements, etc.

Gate lines G extend in the first direction X. Source lines S extend in the second direction Y. A common electrode CE extends in the first direction X. Specifically, the common electrode CE is disposed in each pixel and extends above each source line S, and the common electrode CE is commonly formed over plural pixels PX which neighbor in the first direction X. Although not illustrated, the common electrode CE may be commonly formed over plural pixels PX which neighbor in the second direction Y.

A pixel electrode PE disposed in each pixel PX is located above the common electrode CE. Each pixel electrode PE is formed in an island shape corresponding to the rectangular pixel shape in each pixel PX. In the example illustrated, the pixel electrode PE is formed in a substantially rectangular shape having a less length in the first direction X than in the second direction Y. A plurality of slits PSL, which face the common electrode CE, are formed in each pixel electrode PE. In the example illustrated, each of the slits PSL extends in the second direction Y and has a major axis which is parallel to the second direction Y.

Figure 3A:
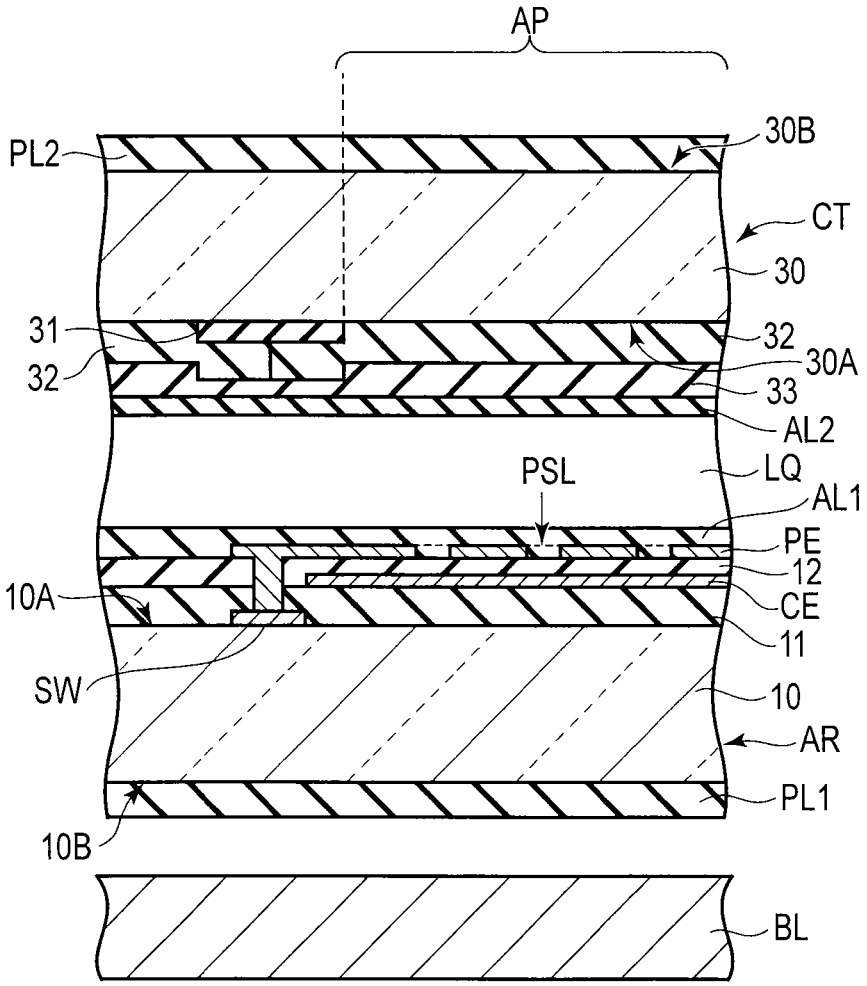
FIG. 3A is a view which schematically illustrates an example of the cross-sectional structure of the liquid crystal display panel shown in FIG. 1.

FIG. 3A is a view which schematically illustrates an example of the cross-sectional structure of the liquid crystal display panel LPN shown in FIG. 1.

Specifically, the array substrate AR is formed by using a first insulative substrate 10 having light transmissivity, such as a glass substrate. The array substrate AR includes, on an inner surface (i.e. a side facing the counter-substrate CT) 10A of the first insulative substrate 10, a switching element SW, a common electrode CE, and a pixel electrode PE.

The switching element SW illustrated in FIG. 3A is, for example, a thin-film transistor (TFT). The switching element SW includes a semiconductor layer which is formed of polysilicon or amorphous silicon. The switching element SW may be of a top gate type or a bottom gate type. The switching element SW is covered with a first insulation film 11.

The common electrode CE is formed on the first insulation film 11. The common electrode CE is formed of a transparent, electrically conductive material such as indium tin oxide (ITO) or indium zinc oxide (IZO). The common electrode CE is covered with a second insulation film 12. The second insulation film 12 is also disposed on the first insulation film 11.

The pixel electrode PE is formed on the second insulation film 12 and is opposed to the common electrode CE. The pixel electrode PE is electrically connected to the switching element SW via a contact hole which penetrates the first insulation film 11 and second insulation film 12. In addition, a slit PSL, which faces the common electrode CE via the second insulation film 12, is formed in the pixel electrode PE. This pixel electrode PE is formed of a transparent, electrically conductive material such as ITO or IZO. The pixel electrode PE is covered with a first alignment film AL1. The first alignment film AL1 is also disposed on the second insulation film 12. The first alignment film AL1 is formed of a material which exhibits horizontal alignment properties, and is disposed on that surface of the array substrate AR, which is in contact with the liquid crystal layer LQ.

On the other hand, the counter-substrate CT is formed by using a second insulative substrate 30 with light transmissivity, such as a glass substrate. The counter-substrate CT includes, on an inner surface (i.e. a side facing the array substrate AR) 30A of the second insulative substrate 30, a black matrix 31 which partitions the pixels PX, color filters 32, and an overcoat layer 33.

The black matrix 31 is opposed to wiring portions, such as gate lines G, source lines S and switching elements SW, which are provided on the array substrate AR, on the inner surface 30A of the second insulative substrate 30, and forms an aperture portion AP which is opposed to the pixel electrode PE. The color filter 32 is formed on the inner surface 30A of the second insulative substrate 30 and is disposed in the aperture portion AP. In addition, the color filter 32 also extends over the black matrix 31. The color filters 32 are formed of resin materials which are colored in mutually different colors, e.g. three primary colors of red, blue and green. Boundaries between the color filters 32 of different colors are located on the black matrix 31.

The overcoat layer 33 covers the color filters 32. The overcoat layer 33 planarizes asperities on the surfaces of the black matrix 31 and color filters 32. The overcoat layer 33 is formed of, for example, a transparent resin material. The overcoat layer 33 is covered with a second alignment film AL2. The second alignment film AL2 is formed of a material which exhibits horizontal alignment properties, and is disposed on that surface of the counter-substrate CT, which is in contact with the liquid crystal layer LQ.

The above-described array substrate AR and counter-substrate CT are disposed such that their first alignment film AL1 and second alignment film AL2 are opposed to each other. In this case, a columnar spacer, which is formed on one of the array substrate AR and counter-substrate CT, creates a predetermined cell gap between the array substrate AR and the counter-substrate CT. The array substrate AR and counter-substrate CT are attached by a sealant in the state in which the cell gap is created therebetween. The liquid crystal layer LQ is composed of a liquid crystal composition including liquid crystal molecules LM which are sealed in the cell gap created between the first alignment film AL1 of the array substrate AR and the second alignment film AL2 of the counter-substrate CT. The liquid crystal layer LQ is formed of, for example, a liquid crystal material with a positive (positive-type) dielectric constant anisotropy, but the liquid crystal layer LQ may be formed of a negative (negative-type) dielectric constant anisotropy.

A backlight BL is disposed on the back side of the liquid crystal display panel LPN having the above-described structure. Various modes are applicable to the backlight BL. As the backlight BL, use may be made of either a backlight which utilizes a light-emitting diode (LED) as a light source, or a backlight which utilizes a cold cathode fluorescent lamp (CCFL) as a light source. A description of the detailed structure of the backlight BL is omitted.

A first polarizer PL1 having a first absorption axis is disposed on an outer surface of the array substrate AR, that is, an outer surface 10B of the first insulative substrate 10. In addition, a second polarizer PL2 having a second absorption axis, which is in a positional relationship of crossed Nicols in relation to the first absorption axis, is disposed on an outer surface of the counter-substrate CT, that is, an outer surface 30B of the second insulative substrate 30. In the meantime, another optical element, such as a retardation plate, may be disposed between the first insulative substrate 10 and the first polarizer PL1, or between the second insulative substrate 30 and the second polarizer PL2.

As illustrated in FIG. 2, the first alignment film AL1 and second alignment film AL2 are subjected to alignment treatment (e.g. rubbing treatment or optical alignment treatment) in mutually parallel azimuth directions in a plane parallel to the substrate major surface (or in an X-Y plane). The first alignment film AL1 is subjected to alignment treatment in a direction crossing the major axis (the second direction Y in the example of FIG. 2) of the slit PSL at an acute angle of 45° or less. An alignment treatment direction R1 of the first alignment film AL1 is, for example, a direction crossing the second direction Y at an angle of 5° to 15°. In addition, the second alignment film AL2 is subjected to alignment treatment in a direction parallel to the alignment treatment direction R1 of the first alignment film AL1. The alignment treatment direction R1 of the first alignment film AL1 and an alignment treatment direction R2 of the second alignment film AL2 are opposite to each other.

In the liquid crystal display device according to the embodiment, in the liquid crystal display panel LPN, the liquid crystal molecules LM are aligned in an initial alignment direction (e.g. alignment direction R1) which is restricted by the first alignment film AL1 and second alignment film AL2, in the state in which no electric field is produced between the pixel electrodes PE and common electrode CE. One of the first absorption axis of the first polarizer PL1 and the second absorption axis of the second polarizer PL2 is parallel to the initial alignment direction of liquid crystal molecules LM, and the other is perpendicular to the initial alignment direction.

Figure 3B:
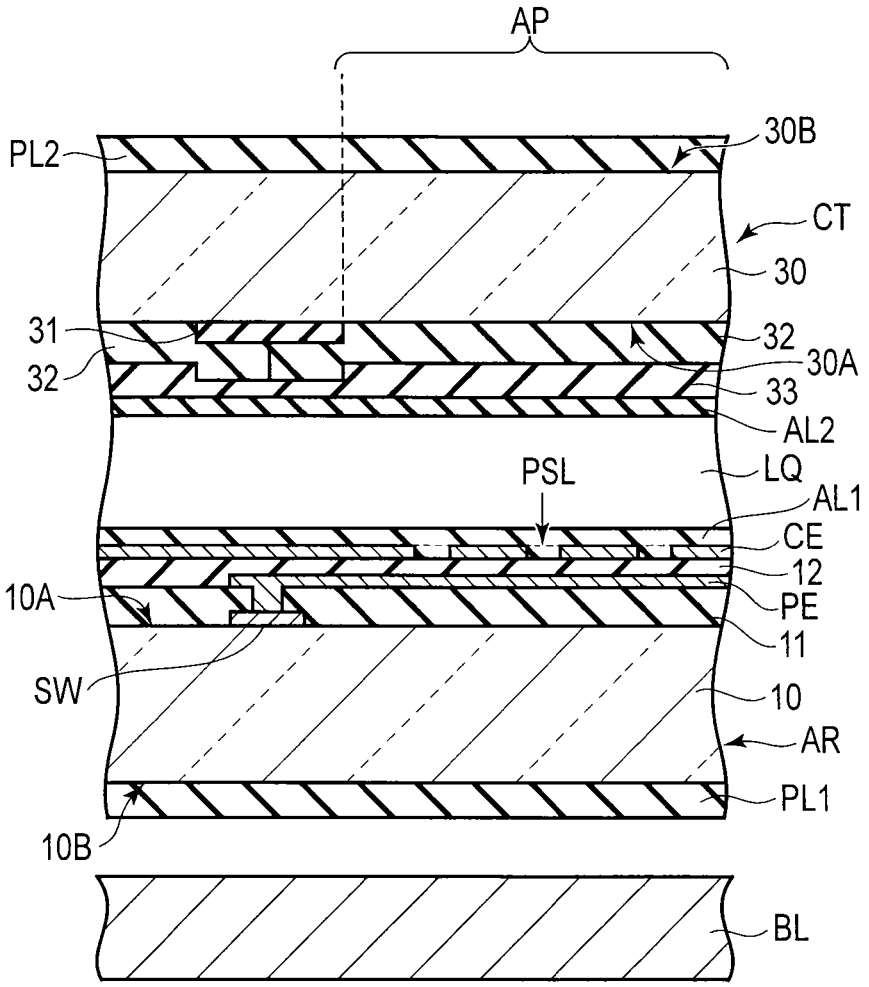
FIG. 3B is a view which schematically illustrates another example of the cross-sectional structure of the liquid crystal display panel shown in FIG. 1.

FIG. 3B is a view which schematically illustrates another example of the cross-sectional structure of the liquid crystal display panel LPN shown in FIG. 1.

This example differs from the example shown in FIG. 3A in that the pixel electrode PE is formed on the first insulation film 11, and the common electrode CE is formed on the second insulation film 12. As regards the other structure, this example is the same as the example shown in FIG. 3A, so a description thereof is omitted.

The pixel electrode PE is located on the first insulation film 11, and is electrically connected to the switching element SW via a contact hole which penetrates the first insulation film 11. The pixel electrode PE is covered with the second insulation film 12.

The common electrode CE is located on the second insulation film 12, and a part thereof is opposed to the pixel electrode PE. A slit PSL, which faces the pixel electrode PE via the second insulation film 12, is formed in the common electrode CE. The common electrode CE is covered with the first alignment film AL1.

Next, the operation of the liquid crystal display device having the above-described structure is described.

An OFF time, at which such a voltage as to produce a potential difference between the pixel electrode PE and common electrode CE is not applied, corresponds to a state in which no voltage is applied to the liquid crystal layer LQ. In this state, no electric field is produced between the pixel electrode PE and the common electrode CE. Thus, the liquid crystal molecules LM included in the liquid crystal layer LQ are initially aligned in a direction crossing the second direction Y at an acute angle in the X-Y plane, as indicated by a solid line in FIG. 2.

At the OFF time, part of light from the backlight BL passes through the first polarizer PL1 and enters the liquid crystal display panel LPN. The polarization state of the light, which enters the liquid crystal display panel LPN, is linear polarization perpendicular to the first absorption axis of the first polarizer PL1. The polarization state of such linearly polarized light hardly varies when the light passes through the liquid crystal display panel LPN at the OFF time. Thus, most of the linearly polarized light, which has passed through the liquid crystal display panel LPN, is absorbed by the second polarizer PL2 (black display).

On the other hand, an ON time, at which such a voltage as to produce a potential difference between the pixel electrode PE and common electrode CE is applied, corresponds to a state in which a voltage is applied to the liquid crystal layer LQ. In this state, a fringe electric field is produced between the pixel electrode PE and the common electrode CE. Thus, the liquid crystal molecules LM are aligned in an azimuth direction different from the initial alignment direction in the X-Y plane, as indicated by a broken line in FIG. 2. In the positive-type liquid crystal material, the liquid crystal molecules LM rotate such that the liquid crystal molecules LM are aligned in a direction substantially parallel to the electric field in the X-Y plane. At this time, the liquid crystal molecules LM are aligned in a direction corresponding to the magnitude of the electric field.

At the ON time, linearly polarized light perpendicular to the first absorption axis of the first polarizer PL1 enters the liquid crystal display panel LPN, and the polarization state of the light varies depending on the alignment state of the liquid crystal molecules LM when the light passes through the liquid crystal layer LQ. Thus, at the ON time, at least part of the light emerging from the liquid crystal layer LQ passes through the second polarizer PL2 (white display).

By the above-described structure, a normally black mode is realized.

Figure 4:
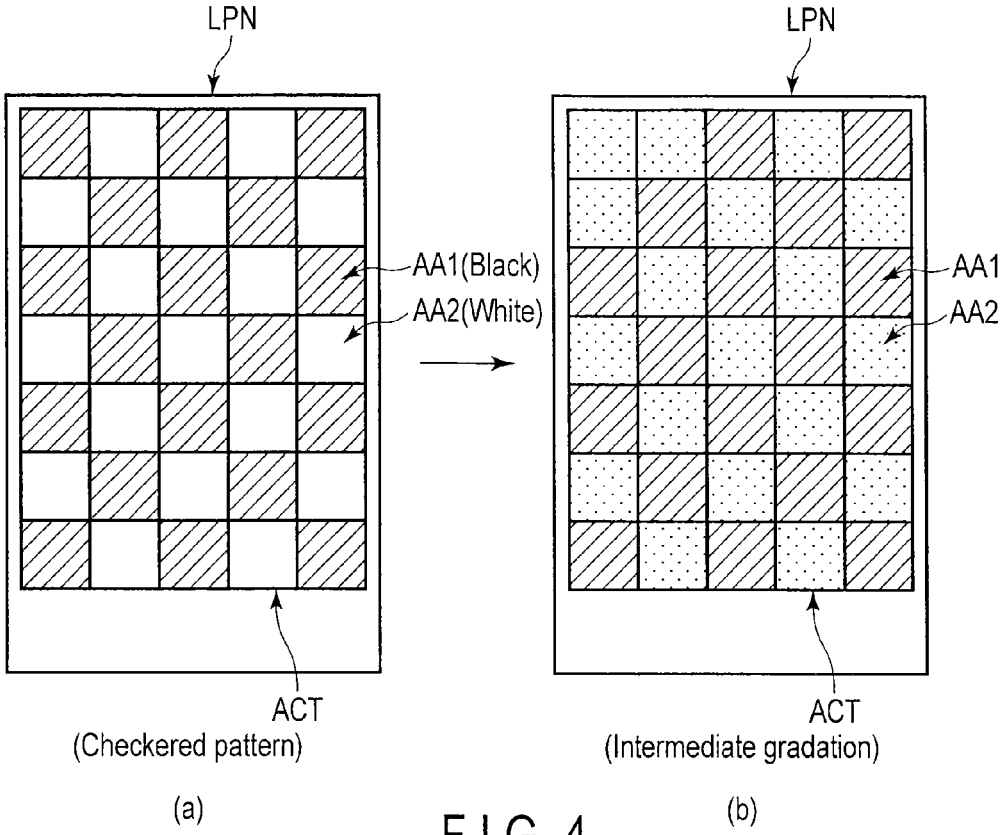
FIG. 4 is a view for explaining an image persistence phenomenon in an FFS-mode liquid crystal display device.

FIG. 4 is a view for explaining an image persistence phenomenon in an FFS-mode liquid crystal display device.

As illustrated in part (a) of FIG. 4, a voltage is applied to the liquid crystal display panel LPN so as to display a black-and-white checkered pattern, and the state in which the checkered pattern is displayed over the entire active area ACT is kept for a predetermined time. For example, in a liquid crystal display device which displays an image with 256 gray levels, black display (gradation value G0) is effected in pixels PX of a first area AA1 of the active area ACT by producing no potential difference between the pixel electrodes PE and common electrode CE. On the other hand, white display is effected in pixels PX of a second area AA2 which neighbors the first area AA1 of the active area ACT, by producing a potential difference corresponding to white display (gradation value G255) between the pixel electrodes PE and common electrode CE.

Thereafter, as illustrated in part (b) of FIG. 4, a voltage is applied to the liquid crystal display panel LPN so as to display an intermediate gradation (e.g. gradation value G127), and a uniform intermediate-gradation image is displayed on the entirety active area ACT. Specifically, a potential difference, which corresponds to the same intermediate-gradation display, is produced between the pixel electrodes PE and common electrode CE in both the pixels PX of the first area AA1 and the pixels PX of the second area AA2. At this time, there is a case in which a luminance, which is substantially equal to the luminance corresponding to the normal intermediate gradation, is obtained on the first area AA1 which has been kept in the black display state, but a luminance, which is higher than the luminance of the normal intermediate gradation, is obtained on the second area AA1 which has been kept in the white display state. In this case, a difference in luminance occurs between the first area AA1 and the second area AA2, and a checkered pattern is visually recognized as an after-image. This phenomenon is the image persistence phenomenon.

Various factors are thinkable as regards the difference in luminance which occurs after the checkered pattern is displayed. An example of such factors is a misalignment of liquid crystal molecules LM. In general, in the OFF state in which no potential difference is produced between the pixel electrodes PE and common electrode CE, the liquid crystal molecules LM are aligned in an alignment axis direction which is substantially parallel to the alignment treatment direction R1 and alignment treatment direction R2. However, when the ON state, in which a potential difference is produced between the pixel electrodes PE and common electrode CE, is kept for a long time, an excessive stress acts on the liquid crystal layer LQ. Thus, even if the potential difference between the pixel electrodes PE and common electrode CE is restored to the OFF state, such a misalignment occurs that the liquid crystal molecules LM fail to completely restore to the alignment axis direction. Specifically, a misalignment hardly occurs in an area with a small stress, such as the first area AA1 where black of the checkered pattern is displayed, whereas a misalignment tends to occur in an area with a continued great stress, such as the second area AA2 where white of the checkered pattern is displayed.

In the liquid crystal display device of the normally black mode, the luminance (or transmittance) becomes substantially zero (i.e. black display) when a potential difference ($|Vd-Vcom|$) between a potential Vcom of the common electrode CE and a potential Vd of the pixel electrode PE is zero, and the luminance increases as the potential difference ($|Vd-Vcom|$) becomes greater. This characteristic is expressed by a T-V characteristic curve which indicates the relationship between the voltage that is applied to the liquid crystal layer, and the luminance.

When a potential difference corresponding to the same intermediate gradation has been produced in an area where a misalignment occurs and in an area where no misalignment occurs, liquid crystal molecules rotate substantially more greatly, relative to the alignment axis direction, in the area where the misalignment occurs than in the area where no misalignment occurs. Thus, the luminance becomes higher in the area where the misalignment occurs than in the area where no misalignment occurs, and the above-described difference in luminance occurs.

In the meantime, when the liquid crystal display device is driven, in order to avoid a flicker phenomenon, such driving is executed that the positive/negative polarity of signals, which are supplied to the pixel electrodes PE, is reversed in every 1 frame period. In the present embodiment, assuming that such polarity reversal driving is adopted, a study is made of the case in which a rectangular-wave voltage of $Vcom \pm V0$ is applied as a pixel electrode potential Vd of the pixel electrode PE.

In addition, consideration is given to the case in which the potential of the common electrode CE is varied, with the rectangular-wave voltage signal as the pixel electrode potential Vd being unchanged. In this case, it is assumed that the initial common electrode potential Vcom has been changed to Vcom', and $\delta V = Vcom' - Vcom$ (hereinafter, $\delta V$ is referred to as "VCOM deviation").

At this time, the absolute value of the potential difference between the pixel electrode potential and the common electrode potential on the positive polarity side decreases by $\delta V$, and the absolute value of the potential difference between the pixel electrode potential and the common electrode potential on the negative polarity side increases by $\delta V$. Specifically, in the case where the common electrode potential is Vcom, when the pixel electrode potential Vd has been set at a potential corresponding to a certain intermediate gradation value (e.g. G127), the luminance obtained at a timing of the positive-polarity potential is substantially equal to the luminance obtained at a timing of the negative-polarity potential, and an average luminance thereof is a luminance L0. On the other hand, in the case where the common electrode potential is Vcom', when the pixel electrode potential Vd has been set at a potential corresponding to a gradation value (G127), a luminance La obtained at a timing of the positive-polarity potential becomes slightly lower than the luminance L0, and a luminance Lb obtained at a timing of the negative-polarity potential becomes much higher than the luminance L0. An imbalance between the luminance La and luminance Lb occurs depending on the T-V characteristic curve. Accordingly, the average luminance ((La+Lb)/2) obtained when the common electrode potential is Vcom' becomes higher than the luminance L0 obtained when the common electrode potential is Vcom.

Figure 5:
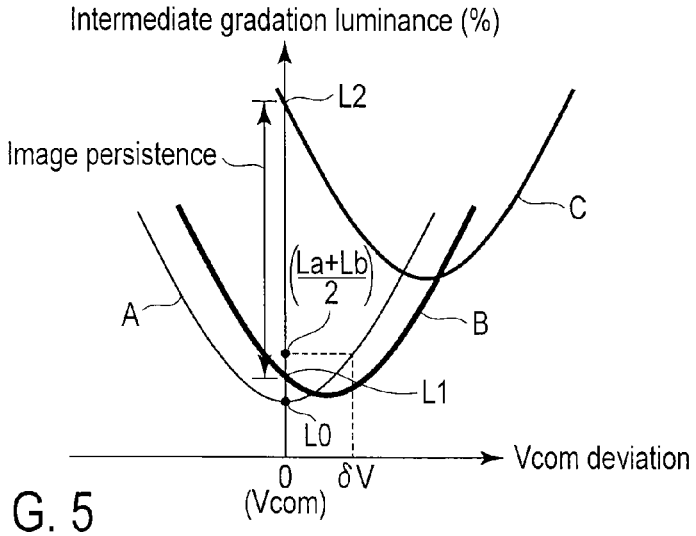
FIG. 5 is a graph showing a relationship between a VCOM deviation δV and an average luminance at a time of displaying a specific intermediate gradation.

FIG. 5 is a graph showing a relationship between a VCOM deviation δV and an average luminance at a time of displaying a specific intermediate gradation.

Symbol A in FIG. 5 denotes a luminance-VCOM deviation curve in a state before the occurrence of an image persistence phenomenon. The luminance-VCOM deviation curve A is symmetric with respect to δV=0 (i.e. Vcom'=Vcom) between the case in which the VCOM deviation δV is positive and the case in which the VCOM deviation δV is negative. In addition, the luminance-VCOM deviation curve A has such a downwardly curved parabolic shape that the luminance (a desired luminance at a time of intermediate gradation display) L0 becomes lowest when δV=0.

Symbol B in FIG. 5 denotes a luminance-VCOM deviation curve after black image persistence in the first area AA1 (i.e. after display of black of a checkered pattern for a predetermined time). The tendency of the luminance-VCOM deviation curve B is substantially equal to that of the luminance-VCOM deviation curve A, although the curve B slightly shifts in a positive direction with respect to the direction of the abscissa. Thus, a luminance L1 at a time of δV=0 is slightly higher than the luminance L0.

Symbol C in FIG. 5 denotes a luminance-VCOM deviation curve after white image persistence in the second area AA2 (i.e. after display of white of the checkered pattern for a predetermined time). The tendency of the luminance-VCOM deviation curve C is substantially equal to that of the luminance-VCOM deviation curve A, but the curve C as a whole shifts in a positive direction with respect to the direction of the abscissa and is also shifts in a positive direction with respect to the direction of the ordinate (i.e. in a direction of an increase of luminance). Thus, a luminance L2 at a time of δV=0 is much higher than the luminance L0 and luminance L1.

Normally, when an image is displayed, the common electrode potential is set at Vcom (δV=0). Thus, when the above-described specific intermediate gradation is displayed, the luminance L1 is obtained in the first area AA1 while the luminance L2 is obtained in the second area AA2, and a difference in luminance therebetween is visually recognized.

Taking the above into account, in the embodiment, a voltage corresponding to a gradation that is displayed is not only applied to the pixel electrode PE, but a DC bias is also applied to each gradation, where necessary. Thereby, the image persistence phenomenon is relaxed. As regards this point, a description is given of the case where a voltage V0 corresponding to a gradation that is displayed is preset for the common electrode Vcom, and a rectangular-wave voltage of Vcom±V0 is applied to the pixel electrode PE as the pixel electrode potential Vd. In this case, the application of the DC bias to the voltage V0 corresponding to a specific gradation corresponds to the superimposition of a DC bias Vb on the rectangular-wave voltage (Vcom±V0) (Vcom±V0+Vb). The rectangular-wave voltage (Vcom±V0+Vb) at this time is asymmetric between the positive polarity and the negative polarity with respect to the common electrode potential Vcom. For example, when the DC bias has a positive polarity, a potential difference of (V0+Vb) is produced relative to the common electrode potential Vcom at a timing when the rectangular-wave voltage has the positive polarity, and a potential difference of (V0−Vb) is produced relative to the common electrode potential Vcom at a timing when the rectangular-wave voltage has the negative polarity. The inventor has found that the stress on the liquid crystal layer can be reduced and the image persistence phenomenon can be relaxed by applying such an asymmetric rectangular-wave voltage to the pixel electrode PE.

Figure 6:
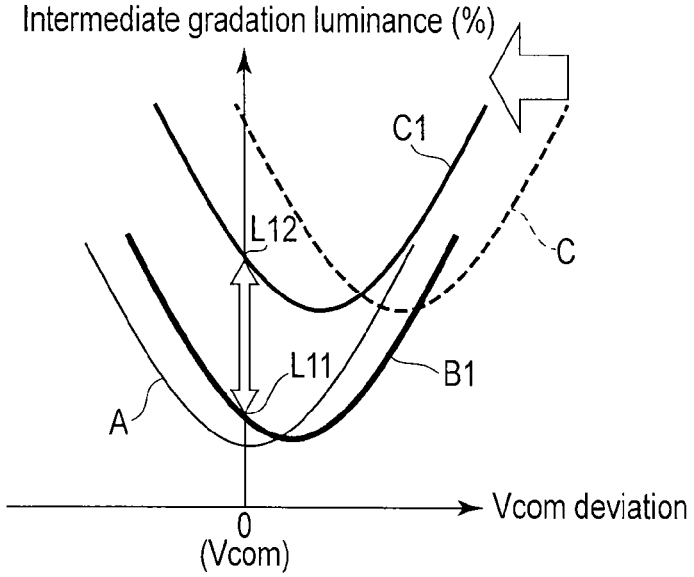
FIG. 6 is a graph showing a relationship between a VCOM deviation δV and an average luminance at a time of displaying a specific intermediate gradation in a first structure example of the embodiment.

FIG. 6 is a graph showing a relationship between a VCOM deviation δV and an average luminance at a time of displaying a specific intermediate gradation in a first structure example of the embodiment.

In this example, a DC bias was applied to the voltage corresponding to a gradation (G255) corresponding to white display.

After keeping for a predetermined time the state in which a checkered pattern is displayed on the entire active area ACT, a specific intermediate gradation is displayed. At this time, a luminance-VCOM deviation curve B1 after black image persistence in the first area AA1 is substantially equal to the luminance-VCOM deviation curve B shown in FIG. 5. Specifically, an intermediate gradation luminance L11 at δV=0 in the luminance-VCOM deviation curve B1 is substantially equal to the intermediate gradation luminance L1 at δV=0 in the luminance-VCOM deviation curve B. On the other hand, a luminance-VCOM deviation curve C1 after white image persistence in the second area AA2 shifts in a negative direction with respect to the direction of the abscissa, compared to the luminance-VCOM deviation curve C. Specifically, an intermediate gradation luminance L12 at δV=0 in the luminance-VCOM deviation curve C1 becomes lower than the intermediate gradation luminance L2 at δV=0 in the luminance-VCOM deviation curve C.

Accordingly, in the case where a normal image is displayed by setting the common electrode potential at Vcom (δV=0), when the above-described specific intermediate gradation is displayed, the luminance L11 is obtained in the first area AA1 while the luminance L12 is obtained in the second area AA2. However, the difference in luminance (L12−L11) is less than the difference in luminance (L2−L1) in the example shown in FIG. 5. Thus, the difference in luminance is not easily visually recognized, and as a result the image persistence phenomenon can be relaxed.

Figure 7:
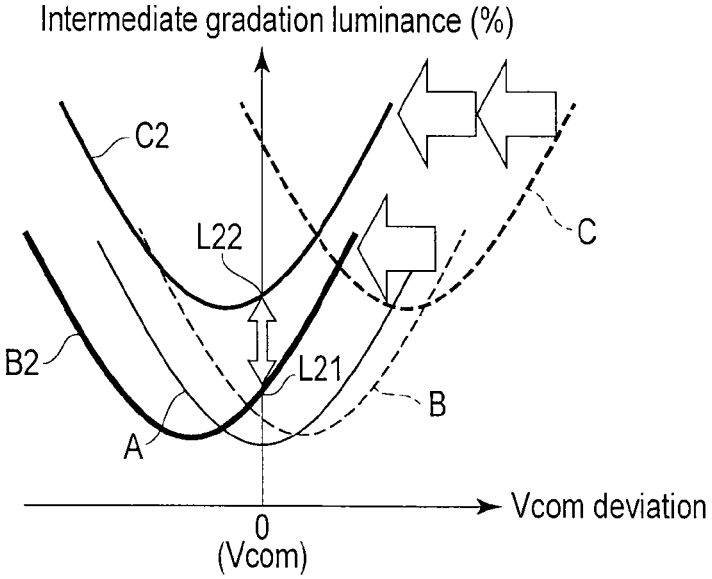
FIG. 7 is a graph showing a relationship between a VCOM deviation δV and an average luminance at a time of displaying a specific intermediate gradation in a second structure example of the embodiment.

FIG. 7 is a graph showing a relationship between a VCOM deviation δV and an average luminance at a time of displaying a specific intermediate gradation in a second structure example of the embodiment.

In this example, in addition to the application of a DC bias to the voltage corresponding to a gradation (G255) corresponding to white display, a DC bias was applied to the voltage corresponding to a specific intermediate gradation (e.g. G31 or G63).

After keeping for a predetermined time the state in which a checkered pattern is displayed on the entire active area ACT, a specific intermediate gradation is displayed. At this time, a luminance-VCOM deviation curve B2 after black image persistence in the first area AA1 shifts in a negative direction with respect to the direction of the abscissa, compared to the luminance-VCOM deviation curve B shown in FIG. 5. On the other hand, a luminance-VCOM deviation curve C2 after white image persistence in the second area AA2 further shifts in the negative direction with respect to the direction of the abscissa, compared to the luminance-VCOM deviation curve C1 shown in FIG. 6.

Accordingly, in the case where a normal image is displayed by setting the common electrode potential at Vcom ($\delta V=0$), when the above-described specific intermediate gradation is displayed, a luminance L21 is obtained in the first area AA1 while a luminance L22 is obtained in the second area AA2. However, the difference in luminance (L22−L21) is less than the difference in luminance (L12−L11) in the example shown in FIG. 6. Thus, the difference in luminance is not easily visually recognized, and as a result the image persistence phenomenon can be further relaxed.

As has been described above, in the normally black mode as in the embodiment, the driving module, which applies a DC bias to a voltage corresponding to a gradation that is displayed on the pixel PX, and supplies the resultant voltage to the pixel electrode PE, applies a higher DC bias in the white display state in which a potential difference is produced between the pixel electrode PE and common electrode CE, than in the black display state in which no potential difference is produced between the pixel electrode PE and common electrode CE.

Next, a description is given of examples corresponding to the first structure example and second structure example of the present embodiment.

Figure 8:
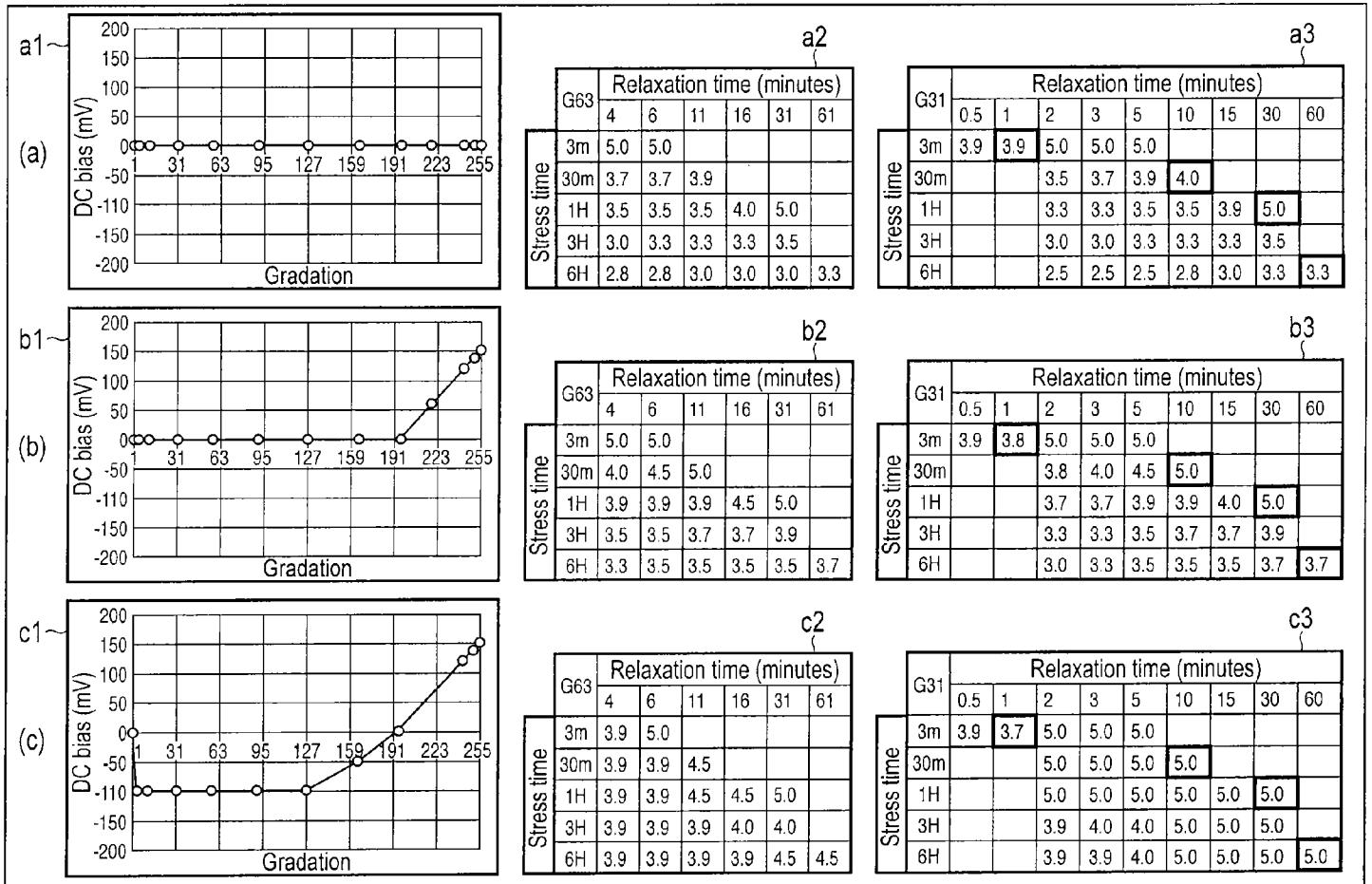
FIG. 8 is a view showing evaluation results of image persistence phenomena in a comparative example, a first example and a second example.

FIG. 8 is a view showing evaluation results of image persistence phenomena in a comparative example, a first example and a second example.

The comparative example shown in part (a) of FIG. 8 corresponds to the case in which a DC bias is applied to none of voltages corresponding to all gradations. The first example shown in part (b) of FIG. 8 corresponds to the above-described first structure example. In the first example, the DC bias is set at zero (mV) on the low gradation side including a black display state, and the DC bias is increased in accordance with an increase of the gradation value on the high gradation side including a white display state. A maximum DC bias is applied in the white display state. The second example shown in part (c) of FIG. 8 corresponds to the above-described second structure example. In the second example, the DC bias of a negative polarity is applied on the low gradation side near the black display state, and the DC bias is increased in accordance with an increase of the gradation value on the high gradation side including the white display state. A maximum DC bias is applied in the white display state.

In FIG. 8, a1, b1 and c1 designate graphs showing the relationships between gradation values and DC biases. The abscissa indicates gradation values, and the ordinate indicates the magnitude (mV) of the DC bias for each gradation value. The graph a1 shows a relationship between the gradation value and the DC bias in the comparative example. The DC bias is set at zero (mV) for any of the gradation values.

The graph b1 shows a relationship between the gradation value and the DC bias in the first example. According to b1, the DC bias is set at zero (mV) for a range from a gradation value G0 (corresponding to the black display state) to the neighborhood of a gradation value G190. The DC bias of the positive polarity is gradually increased in accordance with the increase of the gradation value from the neighborhood of the gradation value G190 to the maximum gradation value G255 (corresponding to the white display state), and the maximum DC bias is set for the gradation value G255. In the example illustrated, the maximum set value of the DC bias is 150 mV, but a still higher DC bias may be set in accordance with the performance of the driving module.

The graph c1 shows a relationship between the gradation value and the DC bias in the second example. According to c1, the DC bias of the negative polarity is set for a range from the gradation value G0 to the neighborhood of the gradation value G190. The DC bias of the positive polarity is gradually increased in accordance with the increase of the gradation value from the neighborhood of the gradation value G190 to the maximum gradation value G255, and the maximum DC bias is set for the gradation value G255. In the example illustrated, the set value of the DC bias is −100 mV on the low gradation side such as a gradation value G31 or a gradation value G63, and the maximum set value of the DC bias is 150 mV. However, the setting of the DC bias may be changed in accordance with the performance of the driving module.

In FIG. 8, tables a2 and a3, tables b2 and b3, and tables c2 and c3 show evaluation results of image-persistence determination levels. The vertical axis indicates a stress time during which the display of a fixed checkered pattern on the entire screen has been continued, and the horizontal axis indicates a relaxation time during which a uniform screen of evaluation gradation values (G31 and G63) has been displayed on the entire screen after the display of the checkered pattern. The values in the tables are average values of determination levels at a time when the observer subjectively evaluated the image persistence state at each time. Level 2 indicates a "very poor" state in which image persistence was conspicuously visually recognized, level 3 indicates a "poor" state in which image persistence was visually recognized, level 4 indicates a state in which image persistence was hardly recognized by observation in a frontal direction, and level 5 indicates a "good" state in which no image persistence was recognized.

The table a2 shows an evaluation result at an evaluation gradation G63 in the comparative example, and the table a3 shows an evaluation result at an evaluation gradation G31 in the comparative example. As is understood, if the stress time is 30 minutes (30 m) or more, it is difficult to obtain the determination level of level 4 or more, regardless of the relaxation time. If the stress time exceeds one hour (1 H), the determination level of level 4 or more is hardly obtained regardless of the relaxation time.

The table b2 shows an evaluation result at an evaluation gradation G63 in the first example, and the table b3 shows an evaluation result at an evaluation gradation G31 in the first example. As is understood, even if the stress time is 30 minutes (30 m) or more, the determination level of level 4 or more tends to be easily obtained with a relatively short relaxation time. Even if the stress time exceeds one hour (1 H), higher determination levels can be generally obtained than in the comparative example.

The table c2 shows an evaluation result at an evaluation gradation G63 in the second example, and the table c3 shows an evaluation result at an evaluation gradation G31 in the second example. As is understood, even if the stress time is one hour (1 H) or more, the determination level of level 4 or more tends to be easily obtained with a relatively short relaxation time. Even if the stress time exceeds one hour (1 H), higher determination levels can be generally obtained than in the first example.

As has been described above, according to the present embodiment, a liquid crystal display device which can improve display quality, and a method of driving the liquid crystal display device can be provided.

In the above-described embodiment, the slits PSL of the pixel electrode PE are formed such that the slits PSL have major axes which are parallel to the second direction Y. Alternatively, the slits PSL of the pixel electrode PE may be formed such that their major axes are parallel to the first direction X or parallel to a direction crossing the first direction X and second direction Y, or the slits PSL of the pixel electrode PE may be formed in a bent shape like an angle bracket (<) shape.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid crystal display device comprising:

a first substrate including a switching element disposed in each of pixels of an active area, a common electrode disposed over a plurality of pixels, a pixel electrode electrically connected to the switching element and disposed in each of the pixels, and a first alignment film;

a second substrate including a second alignment film which is opposed to the first alignment film;

a liquid crystal layer including liquid crystal molecules held between the first alignment film and the second alignment film; and a driving module configured to apply a DC bias to a voltage corresponding to a gradation which is displayed on the pixel and to supply a resultant voltage to the pixel electrode, the driving module being configured to apply a higher DC bias in a white display state in which a potential difference is produced between the pixel electrode and the common electrode than in a black display state in which no potential difference is produced between the pixel electrode and the common electrode, wherein the driving module is configured to apply the DC bias of a negative polarity on a low gradation side near the black display state, and the DC bias of a positive polarity on a high gradation side near the white display state.

2. The liquid crystal display device of claim 1, wherein the DC bias in the white display state has a positive polarity.

3. The liquid crystal display device of claim 1, wherein the driving module is configured to increase the DC bias in accordance with an increase of a gradation value on a high gradation side including the white display state and to apply a maximum DC bias in the white display state.

4. The liquid crystal display device of claim 3, wherein the driving module is configured to set the DC bias at zero (V) on a low gradation side including the black display state.

5. The liquid crystal display device of claim 1, wherein the DC bias has a negative polarity at least in a gradation range of Gmin to Gmid, where a minimum gradation value is denoted by Gmin, a maximum gradation value is denoted by Gmax, and a medium gradation value is denoted by Gmid, which is calculated by Gmid=(Gmin+Gmax)/2.

6. The liquid crystal display device of claim 5, wherein the DC bias is constant at least in the gradation range of Gmin to Gmid.

7. The liquid crystal display device of claim 6, wherein the DC bias is −100 mV.

8. A method of driving a liquid crystal display device, the liquid crystal display device comprising:

a first substrate including a switching element disposed in each of pixels of an active area, a common electrode disposed over a plurality of pixels, an insulation film disposed on the common electrode, a pixel electrode electrically connected to the switching element, disposed in each of the pixels on the insulation film and having a slit formed to face the common electrode, and a first alignment film covering the pixel electrode;

a second substrate including a second alignment film which is opposed to the first alignment film; and a liquid crystal layer including liquid crystal molecules held between the first alignment film and the second alignment film, the method comprising applying a higher DC bias in a white display state in which a potential difference is produced between the pixel electrode and the common electrode than in a black display state in which no potential difference is produced between the pixel electrode and the common electrode, at a time of applying a DC bias to a voltage corresponding to a gradation which is displayed on the pixel and supplying a resultant voltage to the pixel electrode, wherein the DC bias has a negative polarity on a low gradation side near the black display state, and the DC bias has a positive polarity on a high gradation side near the white display state.

9. The method of claim 8, wherein the DC bias in the white display state has a positive polarity.

10. The method of claim 9, wherein the DC bias increases in accordance with an increase of a gradation value on a high gradation side including the white display state and takes a maximum value in the white display state.

11. The method of claim 10, wherein the DC bias is zero (V) on a low gradation side including the black display state.

12. The method of claim 8, wherein the DC bias has a negative polarity at least in a gradation range of Gmin to Gmid, where a minimum gradation value is denoted by Gmin, a maximum gradation value is denoted by Gmax, and a medium gradation value is denoted by Gmid, which is calculated by Gmid=(Gmin+Gmax)/2.

13. The method of claim 12, wherein the DC bias is constant at least in the gradation range of Gmin to Gmid.

14. The method of claim 13, wherein the DC bias is −100 mV.

15. A method of driving a liquid crystal display device, the liquid crystal display device comprising:

a first substrate including a switching element disposed in each of pixels of an active area, a common electrode disposed over a plurality of pixels, a pixel electrode electrically connected to the switching element and disposed in each of the pixels, and a first alignment film;

a second substrate including a second alignment film which is opposed to the first alignment film; and a liquid crystal layer including liquid crystal molecules held between the first alignment film and the second alignment film, the method comprising applying a higher DC bias in a white display state in which a potential difference is produced between the pixel electrode and the common electrode than in a black display state in which no potential difference is produced between the pixel electrode and the common electrode, at a time of applying a DC bias to a voltage corresponding to a gradation which is displayed on the pixel and supplying a resultant voltage to the pixel electrode, wherein the DC bias has a negative polarity on a low gradation side near the black display state, and the DC bias has a positive polarity on a high gradation side near the white display state.

16. The method of claim 15, wherein the DC bias in the white display state has a positive polarity.

17. The method of claim 16, wherein the DC bias increases in accordance with an increase of a gradation value on a high gradation side including the white display state and takes a maximum value in the white display state.

18. The method of claim 17, wherein the DC bias is zero (V) on a low gradation side including the black display state.

19. The method of claim 15, wherein the DC bias has a negative polarity at least in a gradation range of Gmin to Gmid, where a minimum gradation value is denoted by Gmin, a maximum gradation value is denoted by Gmax, and a medium gradation value is denoted by Gmid, which is calculated by Gmid=(Gmin+Gmax)/2.

20. The method of claim 19, wherein the DC bias is constant at least in the gradation range of Gmin to Gmid.

21. The method of claim 20, wherein the DC bias is −100 mV.

* * * * *